US009440458B2

(12) United States Patent
Sunaoshi

(10) Patent No.: US 9,440,458 B2
(45) Date of Patent: Sep. 13, 2016

(54) LIQUID APPLICATION APPARATUS AND IMAGE FORMING SYSTEM

(71) Applicant: Masayuki Sunaoshi, Ibaraki (JP)

(72) Inventor: Masayuki Sunaoshi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/843,247

(22) Filed: Sep. 2, 2015

(65) Prior Publication Data

US 2016/0075150 A1 Mar. 17, 2016

(30) Foreign Application Priority Data

Sep. 17, 2014 (JP) ..... 2014-189336

(51) Int. Cl.
*B41J 11/00* (2006.01)
*B41J 2/175* (2006.01)

(52) U.S. Cl.
CPC ..... *B41J 11/0015* (2013.01); *B41J 2/175* (2013.01); *B41J 2/17563* (2013.01); *B41J 2/17566* (2013.01); *B41J 2/17596* (2013.01)

(58) Field of Classification Search
CPC ..... B41J 2/01; B41J 2/211; B41J 2/2114; B41J 2/015; B41J 2/0015; B41J 2/17; B41J 2/17596; B41J 2/17523; B41J 2/18; B41J 2/17566; B41J 2/195; B41J 2/175; B41J 2/17563; B41J 11/0015
USPC ..... 347/9–22, 84, 85, 88–91, 93, 95–105, 347/5, 6
See application file for complete search history.

(56) References Cited

U.S. PATENT DOCUMENTS 6,350,021 B1 * 2/2002 Gray ..... B41J 2/175 347/78
2008/0273063 A1 * 11/2008 Wouters ..... B41J 2/1707 347/85
2010/0289857 A1 * 11/2010 Bennett ..... B41J 2/18 348/89
2013/0106946 A1 5/2013 Sunaoshi
2014/0146117 A1 5/2014 Sunaoshi

FOREIGN PATENT DOCUMENTS

| | | |
|---|---|---|
| JP | 1-099852 | 4/1989 |
| JP | 3-164262 | 7/1991 |
| JP | 2002-096454 | 4/2002 |
| JP | 2004-330569 | 11/2004 |
| JP | 2013-091260 | 5/2013 |

* cited by examiner

*Primary Examiner* — Matthew Luu
*Assistant Examiner* — Rut Patel
(74) *Attorney, Agent, or Firm* — Oblon, McClelland, Maier & Neustadt, L.L.P.

(57) ABSTRACT

A liquid application apparatus includes a first container, an applicator, a squeezer, a second container, a retreat passage, a filter, an on-off valve, and a sensor. The first container stores a pretreatment liquid before image forming. The retreat passage communicates the first container with the second container. The filter is disposed on the retreat passage to remove foreign substances from the liquid. The on-off valve is disposed between the second container and the filter on the retreat passage. The sensor is disposed at the first container to detect a liquid level of the first container in at least two positions different in height and obtain a flow rate of the liquid in the retreat passage based on a period during which the liquid level moves between the positions when the on-off valve is opened and the liquid stored in the first container is transferred to the second container.

5 Claims, 2 Drawing Sheets

LIQUID APPLICATION APPARATUS AND IMAGE FORMING SYSTEM

CROSS-REFERENCE TO RELATED APPLICATIONS

This patent application is based on and claims priority pursuant to 35 U.S.C. §119(a) to Japanese Patent Application No. 2014-189336, filed on Sep. 17, 2014, in the Japan Patent Office, the entire disclosure of which is hereby incorporated by reference herein.

BACKGROUND

1. Technical Field

Embodiments of the present disclosure relate to a liquid application apparatus that applies pretreatment liquid to a recording medium before image forming, and an image forming system including the liquid application apparatus.

2. Description of the Related Art

As an image forming apparatus, an inkjet printer is known that discharges ink droplets from nozzles of a liquid jetting head and records an image on a recording medium such as a recording sheet. As the inkjet printer, for example, there are a serial printer and a line printer. The serial printer performs printing by combining the operation of discharging ink while moving a liquid jetting head in a main scanning direction (sheet width direction) with respect to a recording sheet with the operation of moving the recording sheet in a sub-scanning direction. The line printer includes a line head having a print width corresponding to the width of a recording sheet, and performs printing while relatively moving the line head and the recording sheet.

Among the line printers, there is a continuous-form printer in which a continuous recording sheet is used as a recording medium suitable for mass printing. The continuous-form printer performs printing by feeding a rolled recording sheet at high speed (0.5 to 2 m/sec). Further, as a continuous-form printer that performs printing on both sides of a recording sheet, there is a technology in which two continuous-form printers are operated in tandem from the viewpoint of resource saving. In this type of apparatus, printing is performed on a first side of the recording sheet at a first continuous-form printer, subsequently the recording sheet is reversed, and then printing is performed on a second side of the recording sheet at a second continuous-form printer.

SUMMARY

In an aspect of this disclosure, there is provided a liquid application apparatus that includes a first container, an applicator, a squeezer, a second container, a retreat passage, a filter, an on-off valve, and a sensor. The first container stores a pretreatment liquid to be applied to a recording medium before image forming. The applicator applies the pretreatment liquid to the recording medium. The squeezer is disposed, inside the first container, at a position capable of scooping the pretreatment liquid to transfer the pretreatment liquid to the applicator and regulate a thickness of a layer of the pretreatment liquid on the applicator. The second container has an airtightness higher than an airtightness of the first container. The retreat passage communicates the first container with the second container. The filter is disposed on the retreat passage to remove foreign substances from the pretreatment liquid transferred through the retreat passage. The on-off valve is disposed between the second container and the filter on the retreat passage. The sensor is disposed at the first container to detect a liquid level of the first container in at least two positions different in height from each other and obtain a flow rate of the pretreatment liquid in the retreat passage based on a period during which the liquid level moves between the at least two positions when the on-off valve is opened and the pretreatment liquid stored in the first container is transferred to the second container.

In an aspect of this disclosure, there is provided an image forming system including the above-described liquid application apparatus and an image forming apparatus. The liquid application apparatus applies the pretreatment liquid to the recording medium before image forming. The image forming apparatus is disposed on a downstream side of the liquid application apparatus in a feeding direction of the recording medium to discharge ink droplets to the recording medium applied with the pretreatment liquid to form an image on the recording medium.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
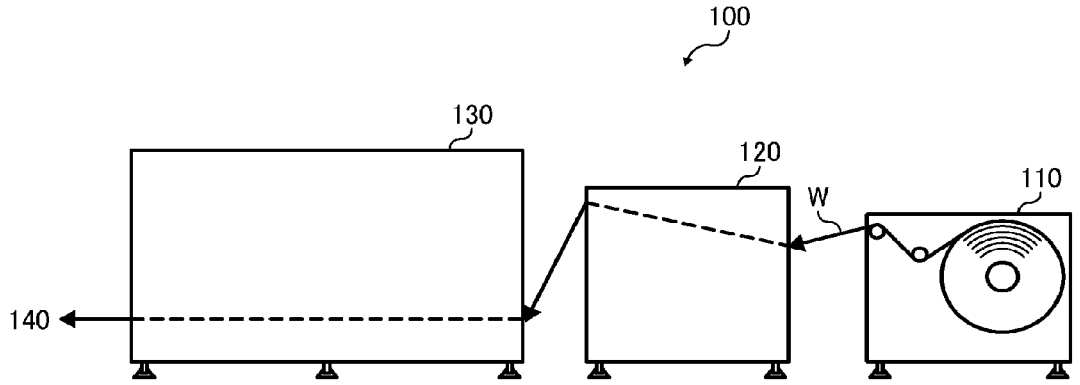
FIG. 1 is a schematic diagram of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

In recent years, image quality is highly qualified in inkjet printers because timing of discharging ink droplets and sizes of the ink droplets can be precisely controlled. However, since image forming is performed by discharging ink droplets to a recording medium, an inkjet printer is subject to phenomena such as feathering in which dots of the ink droplets bleed along paper fibers before the ink droplets are dried, and color bleeding in which adjacent ink droplets having different colors are mixed and make a color boundary ambiguous. Due to this, printing quality may be deteriorated.

To avoid such deterioration of image quality, a technology is known in which pretreatment liquid is applied to a print medium to agglomerate pigment components of ink droplets to prevent ink bleeding. For example, there is a technology in which predetermined liquid that reacts with ink and encourages prevention of ink bleeding is applied by an application roller, a technology in which pretreatment liquid is applied to a recording medium by spraying the pretreatment liquid, and so on.

In such methods for applying pretreatment liquid, viscosity of the pretreatment liquid is controlled because an application amount is varied with the viscosity of the pretreatment liquid. In the case of applying the pretreatment liquid to the recording medium by using the application roller, an application amount is likely to be increased due to increase of the viscosity of the pretreatment liquid. When the application amount is increased, the liquid bleeds over the recording medium, and frictional force of a roller to feed an unrecorded medium is decreased, thereby causing feeding malfunction.

Additionally, for example, drying is not performed sufficiently and an image may be transferred to another unrecorded medium in a later process. To prevent such failures, a technology is proposed in which increase of the viscosity of pretreatment liquid is prevented by transferring the pretreatment liquid contained inside an application unit container to a different container substantially sealed in the case where printing is not operated for a predetermined period.

Thus, according to the unit that transfers the pretreatment liquid from a first container to a second container substantially sealed in the case where printing is not operated for the predetermined period, the pretreatment liquid is generally transferred by a liquid head difference in the aspect of cost. More specifically, the first container is in communication with the second container via a pipe, and the second container is positioned at a position lower than the first container. Further, a solenoid valve is disposed between the first container and the second container, and the solenoid valve is normally set in a closed state. When power supply to the solenoid valve is cut off, the solenoid valve is opened. When the solenoid valve is opened, the pretreatment liquid contained inside the first container is discharged to the second container by the liquid head difference.

Here, according to the above-described technology, the application roller disposed at the first container and adopted to apply the pretreatment liquid to the recording medium constantly contacts the recording medium. Therefore, paper powder or a paper slip is easily mixed into the first container, and clogging is likely to occur in the pipe. To prevent such a situation and avoid a state in which the pretreatment liquid contained inside the first container cannot be discharged, a filter is provided near an outlet of the first container. However, such a mixed state of the paper powder or paper slip is considerably varied by a sheet type to be used and a sheet condition. Due to this, a filter exchange cycle can be hardly set, and a sensor to detect clogging at the filter is needed in addition to the filter in order to prevent clogging in the pipe.

A flow rate sensor is generally used as such a sensor to detect a clogging state at the filter described above. However, the flow rate sensor itself increases passage resistance and may cause extreme decrease of a discharging speed due to the liquid head difference.

According to at least one embodiment of the present disclosure described below, the clogging state of the filter can be detected by measuring the flow rate of the pretreatment liquid without decreasing the discharging speed of the pretreatment liquid.

In the following, an outline of embodiments to implement the present disclosure will be described. A liquid application apparatus according to the embodiment of the present disclosure detects a flow rate of pretreatment liquid flowing into a first filter in order to find a clogging state of a filter disposed at an outlet of the liquid application apparatus. Such detection is performed by detecting a liquid level inside an application unit at different height positions, at least at two positions, and measuring a period during which a liquid level height of the pretreatment liquid is changed when the pretreatment liquid contained inside the application unit is discharged. In other words, the discharging flow rate is detected by obtaining a discharging period of a predetermined volume of the pretreatment liquid stored between electrode pins. By this, the clogging state of the filter can be estimated without increasing passage resistance due to existence of the flow rate sensor.

First Embodiment

A liquid application apparatus according to an embodiment of the present disclosure will be described below based on the drawings. FIG. 1 is a schematic diagram illustrating an image forming system according to an embodiment of the present disclosure. As illustrated in FIG. 1, an image forming system 100 includes a sheet feeding apparatus 110, a pretreatment-liquid application apparatus 120 serving as a liquid application apparatus according to an embodiment of the present disclosure, and a line printer 130. The pretreatment-liquid application apparatus 120 is disposed along a feeding direction of a web W serving as a recording medium. The line printer 130 is disposed downstream of the pretreatment-liquid application apparatus 120 in the feeding direction of the web W.

The web W, which is a recording sheet delivered from the sheet feeding apparatus 110 before image forming, is fed to the pretreatment-liquid application apparatus 120. In the pretreatment-liquid application apparatus 120, treatment agent liquid is applied to an image forming surface of the web W in order to prevent problems of bleed, concentration, color tone, show-through, and so on. The treatment agent liquid has a function to agglomerate ink before ink droplets fall and reach the web W. A surface where the treatment agent liquid is applied is sometimes one side and sometimes both sides depending on a desired printing material. Next, the web W applied with the above treatment is fed to the line printer 130, and a desired image is formed by discharging the ink droplets onto a front side of the web W.

After that, by a reversing apparatus, a front side and a back side of the web W are reversed, and subsequently the web W is fed to a second line printer 140, and the ink droplets are discharged to the back side of the web W to form a desired image. Then, the web is fed to a post-treatment apparatus, and predetermined post-treatment is applied in accordance with necessity.

Figure 2:
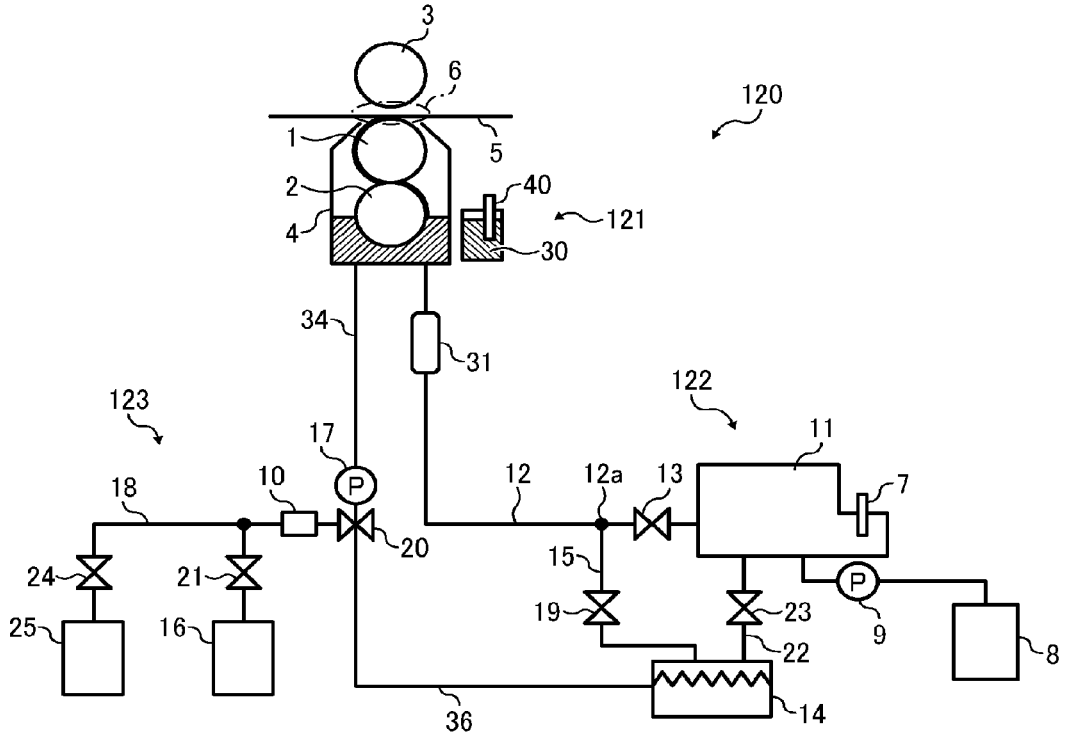
FIG. 2 is a schematic diagram of a liquid application apparatus according to an embodiment of the present disclosure.

Next, the pretreatment-liquid application apparatus 120 is described. FIG. 2 is a schematic diagram illustrating the pretreatment-liquid application apparatus 120 serving as a liquid application apparatus according to an embodiment of the present disclosure. The pretreatment-liquid application apparatus 120 includes a feeding unit for a recording medium, a pretreatment-liquid application unit 121 that applies pretreatment liquid to a sheet of paper, a pretreatment-liquid retreat unit 122 that retreats the pretreatment liquid from the pretreatment-liquid application unit 121, and a pretreatment-liquid supply unit 123 that supplies the pretreatment liquid to the pretreatment-liquid application unit 121. The pretreatment-liquid application unit 121 is disposed on a sheet feed passage.

The pretreatment-liquid application unit 121 includes an application roller 1 which is an applicator to apply the pretreatment liquid to a recording sheet 5, and a squeeze roller 2 which is a squeezer to control the thickness of a layer of the pretreatment liquid to make the layer thin, and transfer the same to the application roller 1. Further, the pretreatment-liquid application unit 121 includes a pressure roller 3 that inserts the recording sheet 5 into a gap with the application roller 1, and a supply pan 4 which is a first container in which the pretreatment liquid is stored.

The squeeze roller 2 is disposed, inside the supply pan 4, at a position where the squeeze roller 2 can scoop the treatment liquid, and immersed in the pretreatment liquid. In the supply pan 4, a liquid-level detection sensor 30 to detect a liquid amount inside the supply pan 4 is provided. The liquid-level detection sensor 30 is communicated so as to have a same liquid level as a liquid level of the supply pan 4. In the liquid-level detection sensor 30, a liquid-level sensor 40 is disposed as a unit to detect a liquid level of at least two height positions, in this case, detected at three liquid level heights: "HIGH level", "CONTROL level", and "LOW level". In the supply pan 4, the liquid level height is controlled to be between "HIGH level" and "CONTROL level" so as to keep an application amount constant during applying operation. The liquid-level sensor 40 of the liquid-level detection sensor 30 includes three electrode pins that detect liquid levels at three different height positions inside the application unit.

The supply pan 4 is formed in a manner covering the application roller 1, and has a form to minimize evaporation of the pretreatment liquid contained inside the supply pan 4. Meanwhile, the supply pan 4 is not generally a sealed system because an opening is needed to be provided at a pressing area 6 between the application roller 1 and the pressure roller 3.

Further, in the pretreatment-liquid application unit 121, the supply pan 4 is provided with a retreat passage 12 to the pretreatment-liquid retreat unit 122, and a first filter 31, namely, a filter is disposed at the retreat passage 12.

The pretreatment-liquid retreat unit 122 includes a reserve tank 11, namely, a second container. The reserve tank 11 is formed as a substantially sealed system in order to prevent evaporation of the pretreatment liquid. Therefore, airtightness therein is higher than the supply pan 4. Further, the reserve tank 11 is communicated with the supply pan 4 via the above-described retreat passage 12. In the retreat passage 12, the above-described first filter 31 and a solenoid valve 13 which is an on-off valve on an upstream side of the reserve tank 11 are disposed. By opening the solenoid valve 13, the pretreatment liquid is fed to the reserve tank 11 from the supply pan 4 by the liquid head difference via the first filter 31. The first filter 31 is disposed on the way of the retreat passage 12, and a coarse-meshed filter may be used as the first filter 31.

With this structure, the viscosity of the pretreatment liquid can be suppressed from being increased in the pretreatment-liquid application apparatus 120. Further, at this point, detected is a period during which the liquid level in the supply pan 4 detectable by the liquid-level detection sensor 30 moves from the "CONTROL level" to below the "LOW level". Based on this detection result, the liquid-level detection sensor 30 obtains a discharging speed of the pretreatment liquid from the supply pan 4. In other words, when the discharging time of the pretreatment liquid is longer than a predetermined value, more specifically, when the flow rate of the pretreatment liquid is a threshold value or lower, the liquid-level detection sensor 30 determines that the first filter 31 is clogged, and notifies an operator of the clogging state of the first filter 31.

Meanwhile, the solenoid valve 13 is opened when printing is stopped for a long time, such as for one hour or more, which is longer than a general interval between print jobs such as replacing the recording sheet 5 and changing a print pattern. This processing prevents waiting time to fill the pretreatment liquid in the supply pan 4 every time printing is stopped.

Further, the solenoid valve 13 is opened in the case where power is not supplied. Therefore, in the case where power supply to the apparatus is cut off, the pretreatment liquid contained inside the supply pan 4 is surely transferred to the reserve tank 11, and the pretreatment liquid is not left inside the supply pan 4 for a long time. Moreover, in the case where the liquid is not used at cycles of several ten days, viscosity of the pretreatment liquid is increased inside the reserve tank as well. Therefore, the liquid contained inside the reserve tank 11 is discharged to a waste liquid tank 8 by a drain pump 9 in order to avoid deterioration of the liquid.

Further, the pretreatment-liquid retreat unit 122 is connected to a circulation passage 15, a solenoid valve 19, a return passage 36, and a second filter 14 via a branch 12*a*. This enables circulation and use of the pretreatment liquid inside the supply pan 4. The second filter 14 is more fine-meshed than the first filter 31. The second filter 14 is connected to a circulation supply passage 22 connected to the reserve tank 11, and the return passage 36 connected to the supply pump 17 side.

A solenoid valve 23 is disposed on the circulation supply passage 22, and a supply pump 17 and a replenishment passage 18 are connected to the return passage 36 via a three-way valve 20. With this structure, the pretreatment-liquid application apparatus 120 according to the embodiment can circulate the pretreatment liquid while applying the pretreatment liquid. This processing is performed by passing a part of the pretreatment liquid stored inside the supply pan 4 through the first filter 31 and the second filter 14 by opening the solenoid valve 19 to allow communication between the second filter 14 side of the three-way valve 20 and the supply pan 4 while driving the supply pump 17.

The pretreatment-liquid supply unit 123 includes a plurality of cartridges, in this embodiment, two cartridges 16, 25, and new pretreatment liquid is supplied to the supply pan 4 from the cartridges 16, 25. The cartridges 16, 25 are connected, via solenoid valves 21, 24, to the three-way valve 20 from the replenishment passage 18 provided with an empty sensor 10. The pretreatment liquid is supplied from the replenishment passage 18 to the supply pan 4 by driving the supply pump 17 while allowing communication between the three-way valve 20 and the cartridges 16, 25 sides. In the case where "no liquid" is detected at the cartridge 16 or 25 by the empty sensor 10, the cartridge to supply the liquid is automatically switched between the cartridges 16, 25. This eliminates necessity to stop the apparatus for cartridge change.

The pretreatment-liquid application apparatus 120 can remove, by the first filter 31 and the second filter 14, paper slips, paper powder, etc. which are generated by sliding operation between the recording sheets 5, application roller 1, and pressure roller 3, and accumulated inside the supply pan 4. As a result, the pretreatment liquid contained inside the supply pan 4 can be prevented from becoming sticky paste.

A supply passage is selected based on a detection result of presence of the pretreatment liquid inside the reserve tank 11 by the sensor 7 disposed inside the reserve tank 11. In the case where the pretreatment liquid is present inside the reserve tank 11, a passage from the circulation supply passage 22 via the second filter 14 is selected, and in the case where no liquid is detected at the reserve tank 11, the supply passage is switched to supply from the cartridges 16, 25.

As described above, according to the pretreatment-liquid application apparatus 120 of the first embodiment, the clogging state of the filter can be detected by measuring the flow rate of the pretreatment liquid without decreasing the discharging speed of the pretreatment liquid.

Second Embodiment

Figure 3:
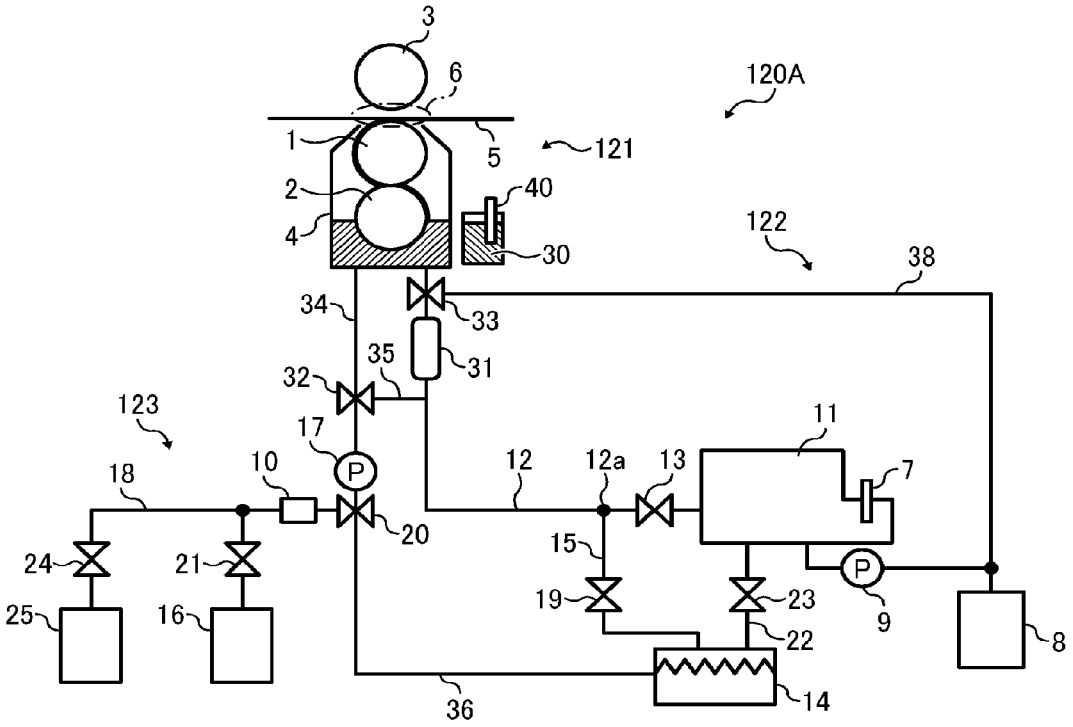
FIG. 3 is a schematic diagram of a liquid application apparatus according to another embodiment of the present disclosure.

Next, a liquid application apparatus according to another embodiment of the present disclosure is described. A liquid application apparatus 120A serving as the liquid application apparatus according to another embodiment of the present disclosure has a structure capable of cleaning a first filter 31 by flowing pretreatment liquid to the first filter 31 from an opposite direction. FIG. 3 is a schematic diagram of the liquid application apparatus 120A serving as the liquid application apparatus according to another embodiment of the present disclosure.

The liquid application apparatus 120A according to the present embodiment includes a first three-way valve 32, a second three-way valve 33, a bypass passage 35, and a drain passage 38 in addition to components included in the pretreatment-liquid application apparatus 120 described in the first embodiment. Other basic components are same as the pretreatment-liquid application apparatus 120 according to the first embodiment.

The bypass passage 35 connects a downstream side of a supply pump 17 on a supply passage 34 with a downstream side of the first filter 31 on a retreat passage 12. A drain passage 38 is connected between a supply pan 4 and the first filter 31 on the retreat passage 12, and the pretreatment liquid in the retreat passage 12 can be discharged outside, namely, to a waste liquid tank 8.

The first three-way valve 32 is connected to three points that are a downstream side of a liquid-level sensor 40 on the supply passage 34, an upstream side of the supply pump 17 on the supply passage 34, and the bypass passage 35. Further, the second three-way valve 33 is connected to three points that are a downstream side of the supply pan 4 on the retreat passage 12, an upstream side of the first filter 31 on the retreat passage 12, and the retreat passage 12.

By operating the first three-way valve 32, a transfer destination of the pretreatment liquid from the supply pump 17 can be set to the supply pan 4 or the retreat passage 12 via a bypass passage 35. Further, by operating the second three-way valve 33, the transfer destination of the pretreatment liquid from the supply pan 4 can be set to the retreat passage 12, or the transfer destination of the pretreatment liquid having passed through the first filter 31 from the bypass passage 35 can be set to the drain passage 38.

When the pretreatment liquid is applied to a recording sheet 5 in the liquid application apparatus 120A, the first three-way valve 32 is operated so as to transfer the pretreatment liquid from the supply pump 17 to the supply pan 4. Further, the second three-way valve 33 is operated so as to transfer the pretreatment liquid from the supply pan 4 to the first filter 31. By this, the pretreatment liquid can be applied to the recording sheet 5 and clogging of the first filter 31 can be detected same as the pretreatment-liquid application apparatus 120 according to the first embodiment.

Further, in the case where the first filter 31 is detected as clogged when a solenoid valve 13 is opened and the pretreatment liquid is transferred to a reserve tank 11 from the supply pan 4 by a liquid head difference in the liquid application apparatus 120A, the first filter 31 is cleaned (backwashed). The clogging of the first filter 31 is detected by a liquid-level detection sensor 30. More specifically, when the period during which the liquid level of the pretreatment liquid inside the supply pan 4 decreases from "CONTROL level" to below "LOW level" is longer than a threshold value and a decrease in the flow rate of the pretreatment liquid in the retreat passage 12 is detected, the liquid-level detection sensor 30 determines that the first filter 31 is clogged.

When the first filter 31 is cleaned, the three-way valve 20 is communicated with cartridges 16, 25, and also the solenoid valve 21 or the solenoid valve 24 is opened to supply the liquid from the cartridge 16 side. Subsequently, the supply pump 17 is driven. Further, the pretreatment liquid is fed to the retreat passage 12 by operating the first three-way valve 32, and the pretreatment liquid is fed to the first filter 31 from the opposite direction. By this, the pretreatment liquid is flown into the first filter 31 in the direction opposite to a normal direction. At this point, the second three-way valve 33 is operated so as to discharge the pretreatment liquid from the first filter 31 to the waste liquid tank 8.

By operating thus, the pretreatment liquid is flown into the first filter 31 in the direction opposite to the normal direction, and a paper slip and the like that have clogged the first filter 31 are removed and discharged to the waste liquid tank 8 together with the pretreatment liquid.

Even in the case where the pretreatment liquid continues flowing in a state that only a part of foreign substances is removed from the first filter 31 at the time of backwashing the first filter 31, the pretreatment liquid flows only from one place where a part of the foreign substances is removed. Therefore, there may be a case where the first filter 31 cannot be sufficiently cleaned. To avoid such a situation, timing to switch the second three-way valve 33 is delayed later than timing to drive the supply pump 17 so as to remove the clogged foreign substances all at once, and high pressure can be applied to the first filter 31 at a breath. Further, since the paper powder and the like clogging a filter can be also easily removed by changing a flow speed, backwashing for the first filter 31 can be performed at a plurality of divided times.

As described above, according to the liquid application apparatus 120A of the second embodiment, a clogging state of the filter can be detected by measuring the flow rate of the pretreatment liquid without decreasing the discharging speed of the pretreatment liquid. Further, when the first filter 31 is clogged, the first filter 31 can be cleaned by flowing back the pretreatment liquid.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid application apparatus, comprising:

a first container to store a pretreatment liquid to be applied to a recording medium before image forming;

an applicator to apply the pretreatment liquid to the recording medium;

a squeezer disposed, inside the first container, at a position capable of scooping the pretreatment liquid to transfer the pretreatment liquid to the applicator and regulate a thickness of a layer of the pretreatment liquid on the applicator;

a second container having an airtightness higher than an airtightness of the first container;

a retreat passage to communicate the first container with the second container;

a filter disposed on the retreat passage to remove foreign substances from the pretreatment liquid transferred through the retreat passage;

an on-off valve disposed between the second container and the filter on the retreat passage;

a sensor disposed at the first container to detect a liquid level of the first container in at least two positions different in height from each other and obtain a flow rate of the pretreatment liquid in the retreat passage based on a period during which the liquid level moves between the at least two positions when the on-off valve is opened and the pretreatment liquid stored in the first container is transferred to the second container;

a supply passage connected to the first container to supply the pretreatment liquid to the first container;

a pump disposed at the supply passage to supply the pretreatment liquid to the first container through the supply passage;

a drain passage connected between the first container and the filter on the retreat passage, the drain passage to discharge the pretreatment liquid contained inside the retreat passage to an outside of the retreat passage;

a bypass passage connecting a downstream side of the pump on the supply passage and a downstream side of the filter on the retreat passage;

a first three-way valve connected to a downstream side of the first container on the supply passage, an upstream side of the pump on the supply passage, and the bypass passage to set a transfer destination of the pretreatment liquid from the pump to the first container or the retreat passage; and a second three-way valve connected to a downstream side of the first container on the retreat passage, an upstream side of the filter on the retreat passage, and the retreat passage to set a transfer destination of the pretreatment liquid from the first container to the retreat passage or set a transfer destination of the pretreatment liquid having passed through the filter from the bypass passage to the drain passage, wherein when the flow rate of the pretreatment liquid in the retreat passage is a threshold value or lower, the pretreatment liquid fed by the pump moves from the bypass passage, passes through the filter, and is discharged from the drain passage by operation of the first three-way valve and the second three-way valve to discharge foreign substances clogged at the filter from the drain passage.

2. The liquid application apparatus according to claim 1, wherein the sensor notifies that the flow rate of the pretreatment liquid in the retreat passage is less than a threshold value.

3. The liquid application apparatus according to claim 1, wherein the sensor determines a clogging state of the filter based on the flow rate of the pretreatment liquid.

4. The liquid application apparatus according to claim 1, further comprising a waste liquid tank connected to the first container through the drain passage, to receive the foreign substances clogged at the filter and discharged from the drain passage.

5. An image forming system, comprising:

the liquid application apparatus according to claim 1 to apply the pretreatment liquid to the recording medium before image forming; and an image forming apparatus disposed on a downstream side of the liquid application apparatus in a feeding direction of the recording medium to discharge ink droplets to the recording medium applied with the pretreatment liquid to form an image on the recording medium.

* * * * *